United States Patent [19]

Carman

[11] Patent Number: 4,838,416

[45] Date of Patent: Jun. 13, 1989

[54] GOLF CLUB HOLSTER

[76] Inventor: Edward R. Carman, Rte. 1, Box 518, Garden Rd., Elmer, N.J. 08318

[21] Appl. No.: 142,518

[22] Filed: Jan. 11, 1988

[51] Int. Cl.[4] ..... B65D 85/20

[52] U.S. Cl. ..... 206/315.2; 150/52 G; 211/70.2

[58] Field of Search ..... 150/52 G; 206/315.1, 206/315.2, 315.3, 315.4, 315.6, 315.7, 315.11; 211/70.2; 273/81 R, 162 R

[56] References Cited

U.S. PATENT DOCUMENTS

| | | | |
|---|---|---|---|
| 2,128,546 | 8/1938 | Venmore | 150/52 G |
| 2,879,819 | 3/1959 | Turnbull | 206/315.4 |
| 3,613,760 | 10/1971 | Koehnle | 150/52 G |
| 3,638,284 | 2/1972 | Baker | 150/52 G |
| 3,664,399 | 5/1972 | Neff | 150/52 G |
| 3,821,976 | 7/1974 | Smith et al. | 150/52 G |
| 4,173,241 | 11/1979 | Stock | 150/52 G |
| 4,195,677 | 4/1980 | Hagg et al. | 150/52 G |
| 4,497,404 | 2/1985 | Lowrance | 150/52 G |

FOREIGN PATENT DOCUMENTS

| | | | |
|---|---|---|---|
| 1091264 | 12/1980 | Canada | 150/52 G |
| 0510020 | 7/1939 | United Kingdom | 150/52 G |
| 1360058 | 7/1974 | United Kingdom | 150/52 G |

*Primary Examiner*—Jimmy G. Foster

*Attorney, Agent, or Firm*—Berman, Aisenberg & Platt

[57] ABSTRACT

A holster for a golf club, particularly a putter, has a tubular shaft and a contoured upper portion extending from the tubular shaft, for receiving the head of the golf club. The holster has a hook attached to the outside for removably securing the holster to a golf bag.

6 Claims, 1 Drawing Sheet

FIG. 1
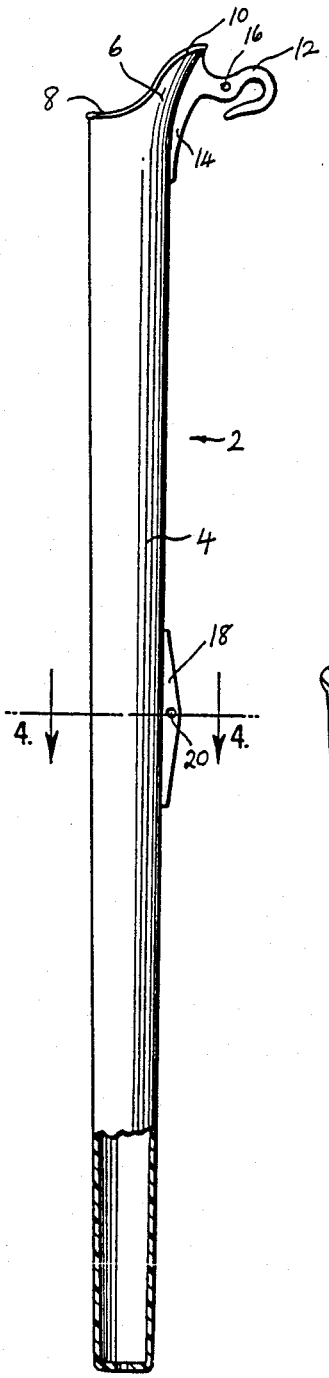
FIG. 2
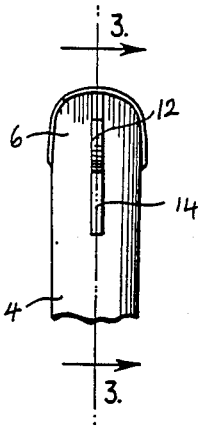
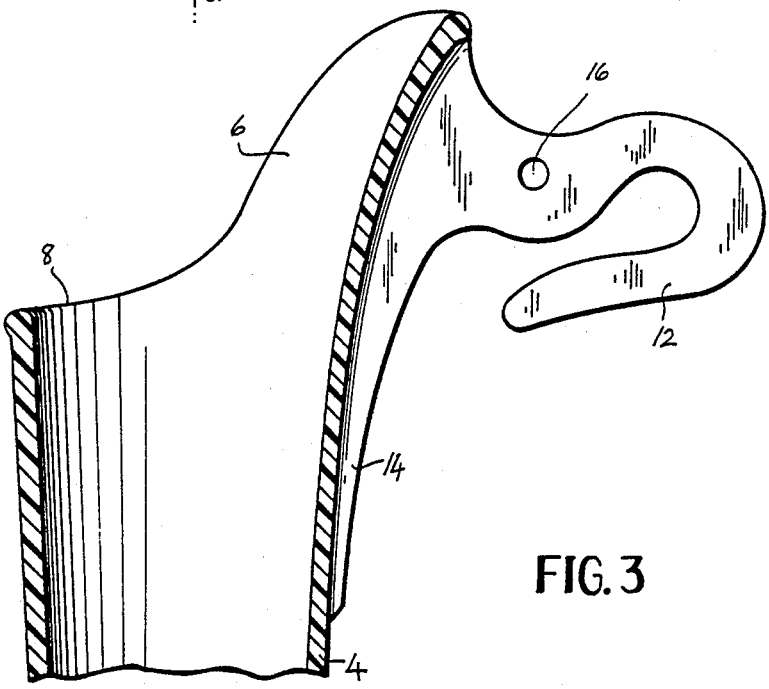
FIG. 3
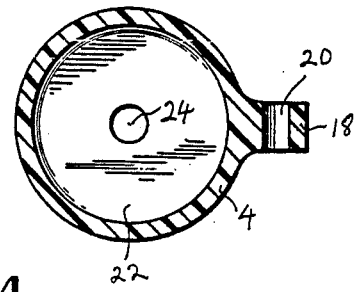
FIG. 4

GOLF CLUB HOLSTER

FIELD OF THE INVENTION

The invention relates to a carrying device for a golf club.

BACKGROUND OF THE INVENTION

Tubular containers for golf clubs are known in the art, but the known containers are not adapted for particular clubs. Golfers often have a "favorite putter" and the device of the invention is intended to facilitate the selection thereof from a bag of clubs.

SUMMARY OF THE INVENTION

The invention comprises a tubular container for a golf club, particularly for, but not limited to, a putter, having a contoured upper portion extending from a tubular shaft portion, for receiving the head of the golf club. The holster may either be placed within the golf bag, placed within a pocket on the outside of the golf bag, or attached to a hook on the bag. The contoured head of the holster is adapted for receiving the head of a golf club, for example, a putter, when the shaft of the club is inserted into the tubular portion of the holster.

It is an object of the invention to provide a golf club holster, particularly a putter holster.

BRIEF DESCRIPTION OF THE DRAWINGS

FIG. 1 is a side elevational view of a golf club holster of the invention.

FIG. 2 is a cut-away back elevational view of the golf club holster of FIG. 1.

FIG. 3 is a cross-sectional view taken on line 3—3 of FIG. 2.

FIG. 4 is a cross-sectional view taken on line 4—4 of FIG. 1.

DETAILED DESCRIPTION OF THE INVENTION

The golf club holster of the invention fills a long-felt need for a device which is distinguished from other golf club holders placed in the bag, and which locates the golfer's "favorite putter" at hand, when needed. The golf club holster of the invention is particularly adapted for attaching to the outside of a golf bag so that a golfer may unhook the holster from the bag and place it inside the bag for storage if desired.

The purpose of the holster is for easy access to the club during a round of golf and to protect the grip and head of the club.

The holster provides easy access to the putter (or other club) in the holster during a round of golf, while protecting the head and grip of the club. The grip is totally enclosed within the tubular portion of the holster.

The holster has a contoured upper portion specially adapted for receiving the head of a club when the club is placed in the holster. FIGS. 1 to 4 illustrate a holster configured for a putter. Other configurations will be apparent to one skilled in the art.

With reference to the figures, in which like numbers represent like parts, FIGS. 1 to 4 show a putter holster of the invention. Putter holster 2 has an elongated tubular shaft 4 and a contoured top portion 6 extending therefrom. Tubular portion 4 may be of even cross-section, or may be slightly tapered from top to bottom of the device. Contoured portion 6 has a lower portion 8 adjacent the top of tubular portion 4 and an upper rest portion 10 in an elevated position to receive the head of the putter. Portion 6 is contoured, as shown in the figures, according to the usual shape of a putter head. The contour of portion 6 may be varied as required.

Clip 12, for removably fastening to a ring on the golf bag, is attached to, or forms an extension of, support 14 which extends from the side of the contoured portion 6 adjacent the most elevated part thereof. Alternatively, clip 12 and support 14 may be attached to tubular portion 4. Aperture 16 may be provided in support 14 for receiving an identification tag or other device. Clip 12, or other device having similar function is used for removably attaching the holster to the golf bag.

Attachment 18, attached to tubular portion 4, also has an aperture 20 therein for optional attachment of an identification tag or other device.

Holster 2 has bottom portion 22 having aperture 24 therein for draining any water which may fall into the holster. The holster may be carried inside the golf bag, outside the golf bag, or separately, but in each instance, the putter or other golf club contained therein is readily accessible to the golfer. The holster may be brightly colored so as to make it readily identifiable.

While the invention has been described above with respect to certain embodiments thereof, it will be appreciated that variations and modifications may be made without departing from the spirit and scope of the invention.

What is claimed is:

1. A holster for a golf club comprising:

tubular means for containing and protecting a golf club shaft portion and grip portion, open contoured means for receiving and protecting a golf club head portion extending from the tubular means, and hook means attached to the open contoured means for securing to a golf bag.

2. A holster of claim 1 wherein the contoured means comprises a shallow curved portion extending from the tubular means, shaped to follow the curve of the head of the golf club.

3. A holster of claim 1 or 2 further comprising means attached to the tubular means for securing to a golf bag.

4. A holster of claim 1 or 2 further comprising means for attaching at least one article to the securing means.

5. A holster of claim 1 or 2 further comprising means for attaching at least one article to the tubular means.

6. A holster of claims 1 or 2 further comprising aperture means in a bottom portion of the tubular means for draining water from within said holster.

* * * * *